United States Patent [19]

Thompson et al.

[11] 4,401,561

[45] Aug. 30, 1983

[54] HYDROTREATING PROCESS WITH AMMONIA INJECTION TO REACTION ZONE EFFLUENT

[75] Inventors: H. Lytle Thompson; Milton L. Kaplan, both of Des Plaines, Ill.

[73] Assignee: UOP Inc., Des Plaines, Ill.

[21] Appl. No.: 333,085

[22] Filed: Dec. 21, 1981

[51] Int. Cl.[3] ..... C10G 29/02

[52] U.S. Cl. ..... 208/212; 208/236

[58] Field of Search ..... 208/236, 212; 423/234; 210/634, 639, 903, 908

[56] References Cited

U.S. PATENT DOCUMENTS

| | | | |
|---|---|---|---|
| 1,276,284 | 8/1918 | Thompson | 208/236 |
| 3,340,182 | 9/1967 | Berkman et al. | 208/212 |
| 3,365,374 | 1/1968 | Short et al. | 208/236 |
| 3,720,602 | 3/1973 | Riley et al. | 208/216 |
| 3,725,252 | 4/1973 | Maier | 208/213 |
| 3,859,200 | 1/1975 | Brunn et al. | 208/216 |
| 3,859,203 | 1/1975 | Brunn et al. | 208/216 |
| 3,887,330 | 6/1975 | Horvath | 208/236 |
| 4,203,830 | 5/1980 | Rollmann et al. | 208/236 |
| 4,230,184 | 10/1980 | Blytas | 208/230 |
| 4,272,357 | 6/1981 | Rollmann | 208/89 |

OTHER PUBLICATIONS

Industrial Engineering Chemistry, Prod. Res. Dev., vol. 14, No. 2, 1975, pp. 74–83, by N. Choudhary et al., entitled "Hydrocracking: A Review".

Chemical Engineering, Mar. 22, 1971, pp. 67–69, by R. J. Annessen and G. D. Gould, entitled "Sour-Water Processing Turns Problem Into Payout".

*Primary Examiner*—Delbert E. Gantz
*Assistant Examiner*—O. Chaudhuri
*Attorney, Agent, or Firm*—James R. Hoatson, Jr., John F. Spears, Jr., William H. Page II

[57] ABSTRACT

A hydrocarbon conversion process highly useful in the hydrotreating of black oils or other high sulfur hydrocarbonaceous compounds which require both desulfurization and denitrification is disclosed. An ammonia source, which is preferably a liquid-phase aqueous stream, is admixed with the reaction zone effluent stream upstream of the product separator. This increases the ammonia present in an aqueous phase which is separated from the reaction zone effluent stream and thereby allows the aqueous phase to contain an increased amount of hydrogen sulfide. The inventive concept has advantages such as lowering the hydrogen sulfide concentration in the hydrogen-rich gas recovered from the reaction zone effluent stream and which is recycled to the reaction zone.

7 Claims, 1 Drawing Figure

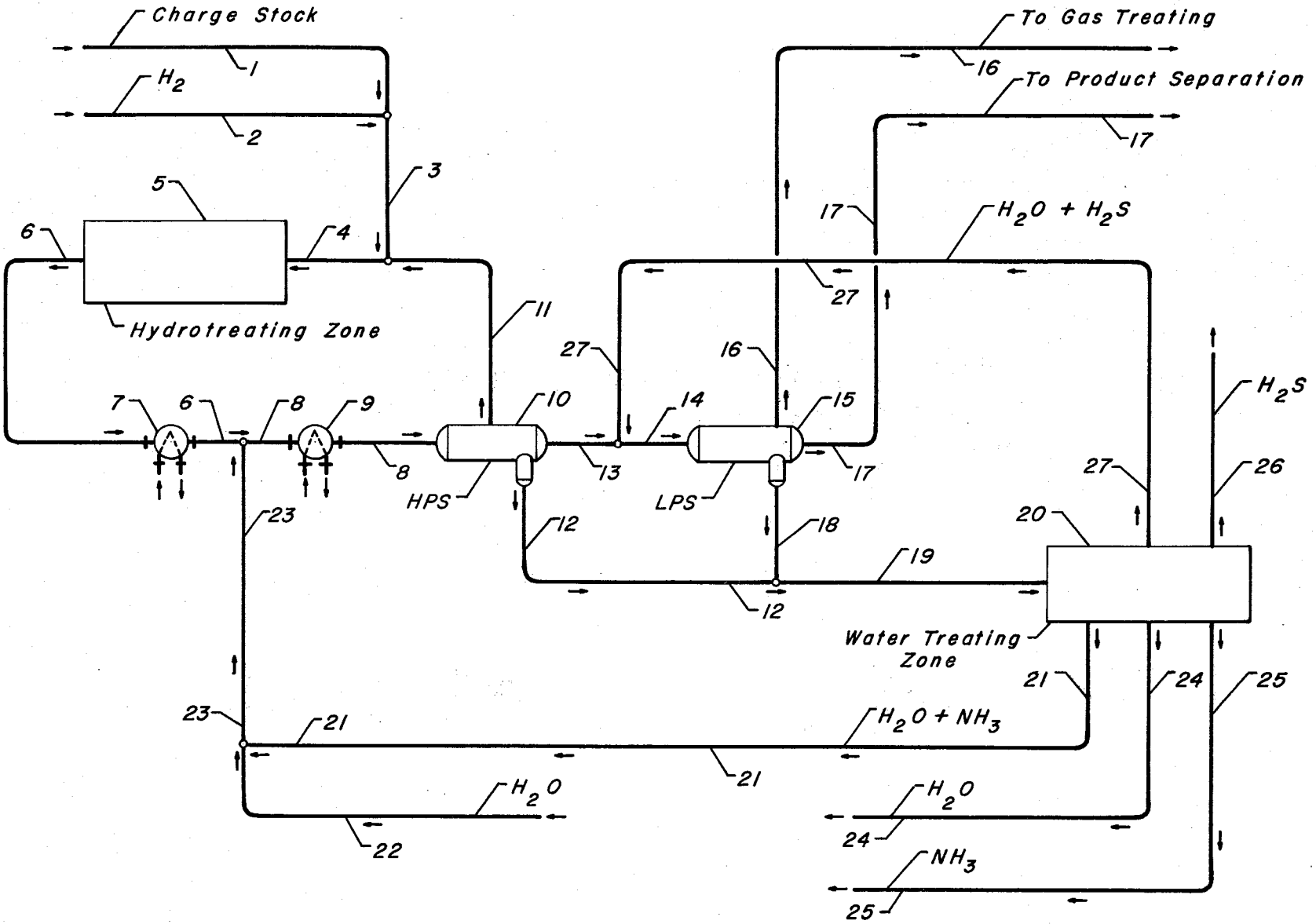
Charge Stock
$H_2$
Hydrotreating Zone
To Gas Treating
To Product Separation
$H_2O + H_2S$
LPS
HPS
Water Treating Zone
$H_2O + NH_3$
$H_2O$
$NH_3$
$H_2S$

HYDROTREATING PROCESS WITH AMMONIA INJECTION TO REACTION ZONE EFFLUENT

FIELD OF THE INVENTION

The invention relates to a process for hydrotreating hydrocarbonaceous materials for the purpose of removing sulfur and nitrogen from these materials. The process is directly concerned with a hydrocarbon conversion process for the hydrodesulfurization and hydrodenitrification of relatively high boiling point hydrocarbonaceous materials such as reduced crude oils or liquid phase materials derived from coal or oil shale. The subject invention therefore relates to those hydrocarbon processing arts normally classified or cross referenced to Class 208 in the classification system of the U.S. Patent and Trademark Office.

DESCRIPTION OF THE PRIOR ART

The art of hydroprocessing or hydrotreating is very well developed and is applied commercially to a large number of different hydrocarbonaceous streams in many petroleum refineries. A survey article printed at page 74 of Volume 14, No. 2, of *Industrial Engineering Chemistry,* Product Research Development, (1975) is indicative of the high level of the art of hydroprocessing in general despite being concerned primarily with hydrocracking.

A well known and commercially practiced feature of hydrodesulfurization processes is the injection of water into the effluent stream of the desulfurization reactor. The purpose of this is to provide an aqueous phase which will dissolve salts formed by the reaction of ammonia and hydrogen sulfide upon the cooling of the reaction zone effluent stream. This practice is described in U.S. Pat. No. 3,725,252 wherein it is taught that it is preferable to inject steam condensate into the effluent mixture ahead of the customary heat exchanger at a rate equivalent to at least 3 vol. % of the total liquid hydrocarbon which is charged to the reaction zone. After cooling in the heat exchanger, the reaction zone effluent stream is passed into a vapor-liquid separator in which the effluent stream is separated into a hydrogen-containing gas stream, an aqueous phase containing $H_2S$ and the dissolved salts and a hydrocarbon phase. The aqueous phase is removed from the hydrocarbon phase by decantation, and the hydrocarbon phase is passed into the appropriate product recovery facilities. This reference also provides an overall description of a hydrodesulfurization process.

U.S. Pat. No. 3,720,602 describes a hydrodesulfurization process in which liquid phase water is withdrawn from a vapor-liquid separator and passed into the reaction zone. This water stream is injected at intermediate points within the reaction zone as a quench material and to enhance catalyst activity.

U.S. Pat. No. 4,272,357 also presents a process for the hydrodesulfurization and demetallization of heavy charge stocks wherein water is separated from the reactor effluent stream and recycled to the reaction zone. The water recycle stream of this reference is passed into the inlet of the reaction zone and therefore becomes part of the reactant mixture which contacts the catalyst utilized in the process. The water stream is recovered from a vapor stream removed from the vapor-liquid separator used for the initial separation of the reaction zone effluent stream, and as such would be expected to contain only very minimal amounts of ammonia. There is believed to be no teaching within this reference of the recycling of ammonia within an aqueous stream. This reference is also pertinent for its description of other desulfurization processes in which water forms part of the reaction zone feed stream.

It is known to inject ammonia directly into the reaction zone of a hydrodesulfurization process. This is described in U.S. Pat. Nos. 3,859,200 and 3,859,203. These references indicate the presence of the ammonia counteracts the normal effects of catalyst aging and allows operation at a reduced hydrogen partial pressure. It is believed that these references are directed solely toward benefits, such as these, which impact specifically on the activity of the catalyst employed in the process, and that these references do not teach the injection of ammonia into the effluent stream of the reaction zone. The latter reference indicates that ammonia may be injected with quench hydrogen downstream of an initial bed of catalyst in a two-stage desulfurization process.

A water treating zone of the type which may be employed in the subject process is disclosed in an article appearing at page 67 of the Mar. 22, 1971 edition of *Chemical Engineering.* This zone is described as being suited for use in a petroleum refinery in conjunction with hydrotreating or hydrodesulfurization units, with the water treating zone receiving water containing ammonia and hydrogen sulfide produced in these units and producing purified water for use in these units.

BRIEF SUMMARY OF THE INVENTION

The invention provides an improved hydrocarbon conversion process useful in the hydrotreating of hydrocarbonaceous materials which contain more sulfur than nitrogen and which require both desulfurization and denitrification. An ammonia source, which is preferably a liquid phase aqueous stream, is admixed into the reaction zone effluent stream to increase the ammonia content of this stream. The basic ammonia ties up acidic hydrogen sulfide within the liquid aqueous phase accumulated in the vapor-liquid separator which receives the reaction zone effluent stream. The hydrogen sulfide concentration in the gas stream removed from the vapor-liquid separator is thereby lowered. This reduces any requirement to remove hydrogen sulfide from this gas stream prior to recycling it to the reaction zone. This is turn reduces the demands on the hydrogen sulfide removal facilities, or increases the hydrogen purity of the recycle gas stream if there are no hydrogen sulfide removal facilities utilized in the process. The invention may also lower the concentration of hydrogen sulfide in the liquid-phase hydrocarbon stream removed from the reactor effluent vapor-liquid separator.

One embodiment of the invention may be characterized as a process which comprises the steps of admixing a recycle gas stream comprising hydrogen with a hydrocarbon stream comprising hydrocarbonaceous compounds which contain sulfur and nitrogen and thereby forming a reaction zone feed stream; contacting the reaction zone feed stream with a hydrotreating catalyst in a hydrotreating zone to form a reaction zone effluent stream which comprises hydrogen, hydrogen sulfide, ammonia and hydrotreated hydrocarbonaceous compounds; admixing an aqueous recycle stream comprising ammonia into the reaction zone effluent stream; separating the reaction zone effluent stream into a liquid phase hydrocarbon stream which is withdrawn as a product stream, a vapor phase stream which is rich in hydrogen and a liquid phase water stream which comprises hydrogen sulfide and ammonia and/or salts of hydrogen sulfide and ammonia; passing the water stream into a water treating zone in which hydrogen sulfide is removed and thereby producing a process water stream having an ammonia to hydrogen sulfide ratio above 2.0:1.0; and recycling at least a portion of the process water stream as the previously specified aqueous stream.

BRIEF DESCRIPTION OF THE DRAWING

The Drawing is a very simplified diagram of a process utilizing the inventive concept for the desulfurization of a heavy oil feed stream containing substantial amounts of sulfur and a lesser amount of nitrogen.

The Drawing illustrates two embodiments of the invention. The feed stream or charge stock enters the process through line 1 and is admixed with a makeup hydrogen gas stream entering the process through line 2. This hydrogen/charge stock admixture is carried by line 3 to the point of its combination with the hydrogen-rich recycle gas stream carried by line 11 and the resulting hydrogen-rich admixture is then passed into hydrotreating zone 5 through line 4. In the hydrotreating zone the charge stock and hydrogen are passed into a reaction zone in which the reactants are contacted with a desulfurization catalyst maintained at hydrodesulfurization conditions under which a substantial portion of the chemically combined sulfur and nitrogen present in the charge stock is converted into hydrogen sulfide and ammonia, respectively. There is thereby produced a hydrotreating zone effluent stream carried by line 6 which comprises desulfurized derivatives of the charge stock, hydrogen, hydrogen sulfide and reaction by-products including lighter hydrocarbons than present in the feed stream and small amounts of ammonia.

The hydrotreating zone effluent stream is cooled in indirect heat exchange means 7 and is then admixed with an aqueous recycle stream carried by line 23. This liquid phase recycle stream comprises water having ammonia dissolved in it. The admixture of the hydrotreating zone effluent stream and the added water is carried by line 8 through a second indirect heat exchange means 9 which assures that substantially all of the $C_6$+hydrocarbons present are converted to a liquid phase material and a large amount of the available useful heat is removed for utilization within the process. The resultant relatively cool mixed phase material is passed into a high pressure separator 10 which functions as a first vapor-liquid separation zone. The vaporous components which enter the high pressure separator are separated into the recycle gas stream carried by line 11. The liquid phase materials which enter the high pressure separator form two separate liquid phases which are continuously withdrawn as the hydrocarbon stream carried by line 13 and a water stream carried by line 12. Depending on such factors as relative concentrations and pH, the aqueous phase may contain free hydrogen sulfide and/or ammonia and will contain various water-soluble salts such as ammonium sulfides and ammonium chlorides. The amount of hydrogen sulfide which is tied up as one of these water-soluble salts or is in some other manner contained within the water stream is increased due to the practice of the subject invention whereby the amount of ammonia which enters the high pressure separator is increased.

The hydrocarbon stream which is withdrawn from the high pressure separator in line 13 is admixed with an aqueous stream comprising dissolved hydrogen sulfide carried by line 27. This admixture is then depressurized to a relatively low pressure and passed into a low pressure separator 15 through line 14. A vapor phase stream comprising materials which are vaporized due to the reduced pressure and any gases whic are evolved from the liquid phase material is removed from the low pressure separator through line 16 and directed to a gas treating facility such as an amine treating unit for the removal of hydrogen sulfide and the recovery of any valuable components contained in this gas stream. The remaining liquid phase hydrocarbons are removed from the low pressure separator in line 17 and passed to product separation facilities such as a stripping column. A denser aqueous phase is removed by decantation from the bottom of the low pressure separator in line 18 and is combined with the water stream removed from the high pressure separator, with the resultant waste water stream being passed into the water treating zone 20 through line 19. Although the water treating zone could take other forms, the water treating zone preferably comprises two stripping columns operated in series. The first stripping column removes hydrogen sulfide from the entering waste water stream, with this hydrogen sulfide being withdrawn from the process through line 26, and preferably also produces a liquid phase water stream which contains substantial amounts of dissolved hydrogen sulfide. In an optional second embodiment of the invention this liquid phase water stream is passed into the low pressure separator via line 27 to ensure a molar excess of hydrogen sulfide over ammonia and to ensure that the gas stream removed from the low pressure separator is sustantially free of ammonia. The use of this hydrogen sulfide source, like the use of the low pressure separator, is not required in the basic embodiment of the invention. The second stripping column of the water treating zone preferably produces a net overhead stream of ammonia which is withdrawn from the process in line 25 and a treated water bottoms stream which is withdrawn from the process in line 24. Also produced in the water treating zone is the aqueous stream containing dissolved ammonia which is admixed into the hydrotreating zone effluent stream via line 21 to tie up hydrogen sulfide. This stream may be augmented by a make up wash water stream fed to the process through line 22. By proper regulation of the flow rate and ammonia content of the ammonia-containing stream carried by line 21, a large amount of the hydrogen sulfide which would otherwise leave the high pressure separator in the recyle gas stream and/or the hydrocarbon stream carried by line 13 will instead be removed in the aqueous stream carried by line 12 and be passed into the water treating zone.

This depiction of one embodiment of the invention is not intended to exclude from the inventive concept other embodiments of the invention including those set out herein or those which are the result of normal and expected modification to these embodiments.

DETAILED DESCRIPTION

As used herein, the term "hydrotreating" is intended to cover the broad spectrum of hydrocarbon conversion processing operations which include hydrodesulfurization, hydrodemetallization, hydrodenitrification and hydrocracking. The term is therefore intended to refer to any hydrocarbon conversion process in which a hydrocarbonaceous charge stock which contains chemically combined sulfur is contacted at suitable operating conditions with a catalytic substance in the presence of hydrogen and hydrogen sulfide results as one of the reaction products. The subject hydrotreating process may therefore be applied to hydrocarbon conversion processes such as hydrocracking in which the major objective is not desulfurization but in which a certain amount of hydrogen sulfide is nevertheless produced within the reaction zone of the operation.

One factor which in most instances significantly influences the performance of a hydrotreating reaction zone is the hydrogen partial pressure in the reaction zone. Low hydrogen partial pressures tend to reduce hydrotreating reaction rates while high hydrogen partial pressures promote the desired reactions and are therefore normally desired. This partial pressure is basically determined by the rate at which hydrogen is recycled to the reaction zone from the reaction zone effluent separation facilities and by the purity of the hydrogen recycle stream. The purity of the hydrogen recycle stream is lessened by the presence of light hydrocarbons such as methane and ethane and is also influenced by the concentration of other reaction by-products such as hydrogen sulfide in the recycle gas. A second factor which is often important to the performance of a catalytic hydrotreating reaction zone is the concentration of hydrogen sulfide in the hydrogen gas stream passed into the reaction zone. The presence of significant amounts of hydrogen sulfide in the hydrogen-rich gas stream entering the reaction zone may therefore be detrimental to the performance of the reaction zone due to both its dilution effect on the hydrogen-rich gas stream and its direct effect on the catalyst present in the reaction zone. It is therefore normally desired that the hydrogen sulfide concentration in the gas streams entering the reaction zone is held to a practical minimum. In some instances this requires the removal of hydrogen sulfide from the recycle gas as by contact with an aqueous amine solution.

It is an objective of the subject invention to minimize the hdyrogen sulfide concentration in the hydrogen-rich recycle gas stream which is passed into the reaction zone of a hydrodesulfurization process. It is another objective of the invention to provide a hydrotreating process for the hydrodesulfurization of charge stocks containing a relatively high concentration of chemically combined sulfur. It is yet another objective of the invention to provide a black oil hydrotreating process. A further objective of the invention is to reduce the amount of hydrogen sulfide which must be removed from hydrogen recycle gas streams in order to maintain a desired hydrogen sulfide concentration in the total feed stream to a hydrotreating zone.

The exact conditions which will be employed in any specific hydrotreating process unit will be dependent on such factors as the composition of the charge stock and the function of the process unit. Hydrotreating conditions may therefore vary from what is referred to as the mild conditions employed during the removal of only small amounts of sulfur from light charge stocks such as naphtha or light gas oils to what is referred to as severe operating conditions and which are employed in the hydrodesulfurization or hydrocracking of black oils such as vacuum column bottoms streams which contain a large amounts of asphaltenes. Mild hydrotreating conditions generally include a lower pressure on the order of from 200 to 1000 psig, a liquid hourly space velocity above 1.0, a hydrogen circulation rate of from about 200 to about 2000 standard cubic feet of hydrogen per barrel of charge stock and a temperature below about 750° F. Severe hydrotreating conditions include a pressure on the order of from 2000 to 4000 psig, a temperature of from about 750° to 980° F., a liquid hourly space velocity of from about 0.2 to 1.0, and a hydrogen circulation rate of about 10,000 to 20,000 standard cubic feet per barrel. A preferred range of hydrotreating conditions includes a pressure of from 1000 to 2500 psig, a temperature of from about 650°–850° F. (343°–454° C.), a liquid hourly space velocity between 0.4 and 2, and a hydrogen circulation rate of from 1000 to 10,000 standard cubic feet per barrel.

The subject process may be applied to the desulfurization or denitrification of atmospheric gas oils, vacuum gas oils, heavy vacuum gas oils, reduced crudes which are normally the portion of the crude oil boiling above about 650° F. and containing from 1 to 15 wt. % asphaltenes, and vacuum column bottoms which normally boil above about 975° F. and contain from 1 to 20 wt. % asphaltenes. Atmospheric or vacuum column bottoms and reduced or topped crudes are often referred to as "black oils". An atmospheric gas oil is normally considered to be a petroleum fraction having a boiling point range of about 400° to about 650 F., and a heavy vacuum gas oil is normally considered to have a boiling point range of about 650° to about 1050° F., with these and the other boiling points and boiling point ranges mentioned herein being determined by the appropriate ASTM distillation method. The process may also be applied when the feed material is a light cycle oil or light distillate having a boiling point range falling between about 400° and about 680° F. A light cycle oil differs from an atmospheric gas oil mainly in that it originates at the main column of a fluidized catalytic cracking unit while the atmospheric gas oil is removed from a crude oil distillation column. Other possible feed streams to the subject process are liquid streams derived by the solvent refining, hydrogenation or pyrolysis of coal, oil shale or tar sands. Other hydrocarbonaceous compounds which contain significant amounts of sulfur and nitrogen include oils produced in coking units and other thermal cracking operations including visbreaking. Another potential source of the hydrocarbonaceous feed stream is synthetic fuel plants which utilize coal as a feedstock.

Although the subject hydrotreating process will be primarily performed for the desulfurization of a charge stock, the hydrotreating process may simultaneously accomplish a large number of other beneficial functions. For instance the hydrotreating process may saturate olefinic and diolefinic components of the feed stream and remove nitrogen, chlorine and other inorganic contaminants by hydrogenation. The hydrotreating process may also serve to remove small amounts of arsenic, lead, copper, tungsten and often higher amounts of nickel and vanadium. The subject hydrotreating process is preferably performed using a fixed bed of a solid catalyst withdownward flow of a mixed phase reactant stream through a cylindrical catalyst bed. However, the subject process may also be employed using a moving or ebulliated bed of catalyst or with a slurry form reactor including those in which the catalyst is produced in situ as by the reaction of vanadium compounds or vanadium with hydrogen sulfide or other sulfur-containing materials.

A large number of hydrotreating catalysts are known and a significant number of suitable catalysts are available from commercial suppliers. A catalyst employed in the process will be chosen based on the composition of the feedstock and the desired objective of the process, and the composition of a catalyst may therefore vary widely. However, it is possible to describe in general terms the most prevalent hydrotreating catalysts. These catalysts typically comprise one or more metallic components supported on an inorganic refractory base. The metallic components of the catalyst will normally comprise one or more elements selected from Group VIII and/or one or more metals from Group VI-B of the Periodic Table of the Elements. These metals are normally chosen from nickel, cobalt, molybdenum, chromium, and tungsten, with iron and platinum also being found in some hydrotreating catalysts. The metallic component of a catalyst may be present as the elemental metal, an oxide or a sulfide or in the form of some other compound. The amount of each metal is generally in the range of from about 1.0 to about 10 wt. % of the total catalyst based on the weight of the elemental metal, although concentrations outside of this range are known. The base or support material of the catalyst plays a significant and important role in determining the effectiveness and suitability of the catalyst. Most commercial hydrotreating catalysts presently being utilized have a base which is formed from alumina, a mixture of alumina and silica, a mixture of alumina with a zeolitic material, or a relatively high purity zeolitic material which may be diluted only to the extent necessary to provide sufficient quantities of binder for the purpose of improving the strength or cohesiveness of the support material. Most commercial hydrocracking catalysts employ a support which is a combination of silica and an alumina. These may be classified as acid treated aluminosilicates, amorphous synthetic silica-alumina combinations, and crystalline synthetic silica-alumina combinations. These synthetic silica-alumina materials, commonly referred to as zeolites, are typically chosen from the group consisting of mordenite, zeolite X and zeolite Y, with increasing attention being directed to other zeolites, such as the zeolite ZSM-5. Further details on suitable catalyst may be obtained from the previously cited references and U.S. Pat. Nos. 3,726,788 and 4,181,602.

The contacting of the charge stock/hydrogen admixture with the catalyst at hydrotreating conditions should result in a substantial performance of the desired function of the process and in the production of a normally mixed phase stream referred to as the reaction zone effluent stream. This effluent stream is typically first heat exchanged against one or more feed streams to recover useful heat by transferring the heat to the feed stream, with the reaction zone effluent stream then being further cooled by heat exchange against one or more lower temperature fluids which require heating such as the feed stream to a fractionation column. Finally, the reaction zone effluent stream may be cooled through the use of air and/or cooling water to a relatively low temperature below about 100° F. The result of this cooling would be the production of a mixed phase stream comprising a vapor phase containing substantial amounts of hydrogen and reaction by-products including hydrogen sulfide, water vapor, and light hydrocarbons such as methane and ethane and a liquid phase comprising condensed hydrocarbons or other hydrocarbonaceous compounds. Liquid phase water is also normally present in the reaction zone effluent stream. This mixed phase stream may then be passed into a vapor-liquid separator from which the vapor phase stream is removed for possible treatment and for the recycling of the hydrogen. The liquid phase hydrocarbon material is also withdrawn for separation and product recovery. As an alternative to this direct cooling and single stage separation procedure, a more complicated separation method such as that shown in the drawing or described in U.S. Pat. Nos. 3,402,122 or 3,847,799 may be employed.

The presence of hydrogen sulfide, ammonia and hydrogen chloride in the reaction zone effluent stream can result in the formation of solid deposits when the effluent stream is cooled. The major constituents of these deposits are ammonium chloride and ammonium polysulfides. These deposits may reduce the heat transfer rate within the heat exchangers and also cause an excessive pressure drop buildup. It is therefore a common practice in the prior art to inject steam condensate into the effluent stream at a point upstream of the heat exchanger in order to afford a method of washing such deposits out of the heat exchangers or to prevent their deposition. A condensate injection rate on the order of at least 3 vol. % of the total liquid hydrocarbon which is charged to the reaction zone is typical. This rate not only provides sufficient water to dissolve the hydrocarbon-insoluble materials, but it assures that there will be intimate mixing of the hydrocarbon and water and that the water-soluble salts will readily pass into solution. Water may also be present in the reaction zone effluent stream due to water production within the reaction zone by the hydrogenation of oxygen-containing compounds and/or due to the injection of water into the reaction zone as part of the feed stream. Cooling the reaction zone effluent therefore normally produces a separable aqueous phase which will contain a mixture of dissolved chemical compounds derived from the hydrogen sulfide and ammonia present in the reaction zone effluent stream. The concentration of each compound in the aqueous phase is determined by such factors as feedstock composition, catalyst activity, water addition rates and the separator temperature and pressure.

The liquid phase hydrocarbons collected in the vapor-liquid separator which receives the reaction zone effluent stream may be passed into a second vapor-liquid separator operated at a substantially lower pressure in the range of from about 100 to about 200 psi and referred to as a low pressure separator. This will result in the evolution of gases dissolved in the liquid phase such as hydrogen, hydrogen sulfide and methane. These gases are withdrawn from the low pressure separator for suitable treatment and possible recycling of recovered hydrogen. The liquid hydrocarbon phase formed in the low pressure separator may then be passed into the appropriate fractionation facilities for the recovery of the desired product or possibly separated into one or more recycle streams in addition to a product stream. In an alternative processing mode, a two-stage hydrotreating process may be employed in which the liquid phase stream removed from the high pressure vapor-liquid separator is combined with an additional amount of hydrogen and passed into a second downstream hydrotreating zone. The second hydrotreating zone may be operated under similar or substantially different conditions and may utilize a different catalyst. For instance a heavy oil fraction could be subjected to a hydrodemetallization step in a first hydrotreating reaction zone, with the liquid phase product of the first zone then being passed into a second hydrotreating reaction zone for the purpose of hydrodesulfurization or hydrocracking.

A variety of different processing flow schemes utilizing one or two hydrotreating reaction zones have been developed. These process flows feature such variations as the recycling of a portion of the liquid phase product of the first hydrotreating zone to the first hydrotreating zone or recycling a specific portion, typically the heaviest portion, of the liquid phase effluent of the second hydrotreating reaction zone to the first hydrotreating reaction zone. The subject process could be employed with any of these possible flow variations in which a significant amount of hydrogen sulfide is evolved, and the invention could be employed at any point at which conditions result in the formation of a separate aqueous phase which is in contact with and then separated from the hydrocarbonaceous effluent of the hydrotreating reaction zone. The subject invention could therefore be employed in both the first and the second stage of a two-stage hydrotreating process.

The subject invention comprises injecting an ammonia source into the hydrotreating zone effluent stream at a point downstream of the hydrotreating reactor outlet and upstream of the point at which a separate aqueous phase is separated by decantation from the reaction zone effluent stream. Preferably the ammonia source is injected simultaneously with the addition of the water which is injected for the purpose of preventing the formation of the previously described solid deposits. The term "ammonia source" as used herein is intended to refer broadly to any compound or class of chemical compounds or fluid stream which is capable of either releasing ammonia into the reaction zone effluent stream or which contains available ammonia and which is suitable for admixture with the hydrotreating reaction zone effluent stream. The ammonia source therefore could be a stream of relatively high purity ammonia, a chemical compound which yields ammonia upon contact with either the water or hydrocarbonaceous materials present in the hydrotreating reaction zone effluent stream, a hydrocarbonaceous stream containing dissolved ammonia or an aqueous stream containing dissolved ammonia.

It is very highly preferred that the ammonia source is an aqueous stream containing dissolved ammonia. This aqueous stream should contain at least 0.01 mole percent ammonia. More preferably this aqueous stream contains at least 0.05 mole percent ammonia. The upper limit on the ammonia content of the aqueous streams is set by the equilibrium concentration at the conditions present at the source of the aqueous stream and the use of maximum or equilibrium ammonia concentrations is possible. The ammonia content of the water stream used as the ammonia source could therefore be as high as 0.1 to 1.0 mole percent.

The amount of ammonia which is injected into the hydrotreating zone effluent stream according to the subject process is subject to significant variation. It is preferred that the amount of ammonia which is added to the hydrotreating reaction zone effluent stream is not sufficient to result in either a substantial increase in the amount of ammonia which is recycled to the reaction zone via any hydrogen recycle stream or to cause the concentration of ammonia to exceed the concentration of hydrogen sulfide in any vapor stream which is removed from the vapor-liquid separator which receives the hydrotreating reaction zone effluent stream. The minimum amount of the ammonia source which is to be injected is that which results in the minimum acceptable conversion of free hydrogen sulfide into product compounds of hydrogen sulfide and ammonia. It is preferred that the mole ratio of hydrogen sulfide to ammonia in the liquid phase water which is separated from the effluent downstream of the point of ammonia source addition is within the broad range of from about 0.5:1.0 to about 2.0:1.0. It is especially preferred that the mole ratio of hydrogen sulfide to ammonia is maintained above 1.1:1.0 whenever gases removed from the separator are to be passed into a sulfur recovery facility. This is to prevent the entrance of ammonia into the sulfur recovery zones which do not function as well with ammonia in the feed streams.

Since hydrogen sulfide produces an acidic solution and ammonia produces a basic solution in water, it is possible to compare the relative amounts of hydrogen sulfide and ammonia which entered the aqueous stream by monitoring the pH of the stream. It is preferred that the rate of ammonia source injection is controlled by monitoring the pH of the water which is removed by decantation from the partially condensed hydrotreating reaction zone effluent stream. It is preferred that the pH of this aqueous stream is in the broad range of from 4.0 to 11. It is more highly preferred that the pH of this aqueous stream is below 9, and it is especially preferred that the pH of this stream is above about 5.0 and about 8.0.

In accordance with this description, one embodiment of the subject invention may be characterized as a hydrotreating process which comprises the steps of passing a feed stream which comprises hydrogen and sulfur-containing $C_{10}$-plus hydrocarbonaceous compounds into a hydrotreating reaction zone operated at conditions effective to produce the hydrotreating reaction zone effluent stream which comprises hydrogen, hydrogen sulfide and $C_{10}$-plus hydrocarbonaceous compounds; admixing an ammonia source into the reaction zone effluent stream; passing the hydrotreating reaction zone effluent stream into a separation zone operated at a lower temperature than the hydrotreating reaction zone; withdrawing a hydrogen-rich gas stream from the separation zone; withdrawing a liquid stream which is rich in the $C_{10}$-plus hydrocarbonaceous compounds from the separation zone, and recovering a product from said liquid stream; and withdrawing an aqueous stream which comprises the reaction products of hydrogen sulfide and ammonia from the separation zone. As used herein the term "rich" is intended to indicate a concentration of the specified compound or group of compounds which is greater than 50 mole percent.

The aqueous stream which is withdrawn from the separation zone is preferably passed into a water treatment zone in which hydrogen sulfide and ammonia are removed from the water. Preferably this zone comprises two fractionation columns operated as strippers, with the waste water stream entering the first column and the bottoms stream of the first column being fed to the second column. The first stripping column is preferably operated under conditions which result in the removal of a sizable amount of the hydrogen sulfide from the entering aqueous stream as a net overhead vapor stream. The bottoms stream of this first stripping column contains the very great majority of all the ammonia which enters the column and is passed into the second stripping column, which is operated under conditions which cause the stripping of this ammonia from the entering water. This causes the formation of a second net overhead stream which is rich in ammonia. Sodium hydroxide could be charged to the bottom of this ammonia stripping column to release ammonia tied up as ammonia chloride. This causes the water removed from the bottom of the stripping column to contain sodium chloride instead of ammonia chloride.

The ammonia source utilized in the subject invention may be a portion of the net bottoms stream of the first stripping column. As an alternative mode of operation, the second stripping column may be operated such that the net bottoms stream of this column contains a sufficient amount of ammonia to allow the bottoms stream of this column to be utilized as the ammonia source. Water withdrawn from the overhead receiver of the second column (ammonia stripper) may also be used as the ammonia source. It is preferred that whatever water stream is used as the ammonia source has a pH above 8.5. It is also preferred that this water stream would have an ammonia to hydrogen sulfide mole ratio above 1.5:1.0 and more preferably above 2.0:1.0. The recovery of separate streams of hydrogen sulfide and ammonia from a sour water stream produced in a hydrotreating process is described in the previously cited *Chemical Engineering* article.

In a second basic embodiment of the invention, which is shown in the drawing, an ammonia source is added to the reaction zone effluent stream upstream of a high pressure separation zone and a hydrogen sulfide source is added to the hydrocarbon stream transferred from the high pressure separation zone to a low pressure separation zone. The reason for adding the hydrogen sulfide is to lower or eliminate the presence of ammonia in the vapor stream removed from the second vapor-liquid separator when this vapor stream is to be passed into a facility in which the ammonia would have a deleterious effect. In this embodiment of the invention, the term "separation zone" is intended to include both the first and the second vapor-liquid separators. The hydrogen sulfide source is preferably a liquid phase aqueous stream produced in the water treating zone which receives the combined water removed from the first and the second separators. The preferred source of this aqueous stream is the overhead receiver of the hydrogen sulfide stripping (first) column. This stream preferably has a pH below 6 and more preferably below 5.0. A hydrogen sulfide to ammonia mole ratio above 1.2:1.0 is preferred for this aqueous stream, with a ratio above 1.5:1.0 being especially preferred. The hydrogen sulfide source could be derived from other sources such as water treating zones associated with different hydrotreating units. The aqueous hydrogen sulfide source could also be derived from water removed from a vapor-liquid separator of a hydrodesulfurization unit or other hydrotreating unit.

We claim as our invention:

1. A hydrotreating process which comprises the steps of:

(a) passing a feed stream which comprises hydrogen, sulfur-containing compounds and hydrocarbonaceous compounds into a hydrotreating reaction zone operated at conditions effective to produce a hydrotreating reaction zone effluent stream comprising hydrogen, hydrogen sulfide and hydrocarbonaceous compounds;

(b) admixing an aqueous stream containing an ammonia source in a quantity sufficient to provide at least 0.05 mole percent ammonia into the entire hydrotreating reaction zone effluent stream before any phase separation of said effluent;

(c) passing the entire hydrotreating reaction zone effluent into a first vapor-liquid separator to separate a hydrogen recycle stream, an aqueous stream containing ammonia and hydrogen sulfide and a first vapor-liquid separator effluent stream containing said hydrocarbonaceous products;

(d) recycling at least a portion of said hydrogen gas stream to said hydrotreating reaction zone;

(e) admixing an aqueous stream containing a hydrogen sulfide source into said first vapor-liquid separator effluent stream containing hydrocarbonaceous products;

(f) passing said admixture formed in step (e) to a second vapor-liquid separator to form an aqueous stream containing ammonia and hydrogen sulfide, a stream containing hydrocarbonaceous products and a vent gas stream;

(g) combining said aqueous streams of steps (c) and (f) and treating said streams in water treating zone to obtain:

i. an aqueous stream;

ii. an ammonia stream;

iii. a hydrogen sulfide stream;

iv. an aqueous stream containing said ammonia source which is used as at least a portion of said aqueous stream in step (b) augmented to said entire hydrotreating reaction zone effluent; and v. an aqueous hydrogen sulfide stream which is used as at least a portion of said aqueous hydrogen sulfide stream augmented to said process at a point intermediate said first vapor-liquid separator and said second vapor-liquid separator; and (h) recovering said hydrotreated hydrocarbonaceous reaction products from step (f).

2. The process of claim 1 further characterized in that the ammonia source is a liquid-phase water stream and is admixed into the hydrotreating reaction zone effluent stream upstream of a heat exchange means.

3. The process of claim 1 further characterized in that the aqueous stream containing said ammonia source provides a pH above 8.5.

4. The process of claim 2 further characterized in that the aqueous stream containing said ammonia source provides an ammonia to hydrogen sulfide mole ratio above 1.5:1.0.

5. The process of claim 1 further characterized in that the hydrocarbonaceous compounds of the feed stream are derived from petroleum.

6. The process of claim 1 further characterized in that the feed stream comprises a coal-derived liquid.

7. The process of claim 1 further characterized in that the hydrocarbonaceous compounds of the feed stream are derived from oil shale.

* * * * *